US005584643A

United States Patent [19]

Nishimura et al.

[11] Patent Number: 5,584,643

[45] Date of Patent: Dec. 17, 1996

[54] WORKING TOOL UNIT OF CONSTRUCTION MACHINE

[75] Inventors: Satoru Nishimura, Kashiwazaki; Hidetoshi Sasaki, Kawasaki, both of Japan

[73] Assignee: Kabushiki Kaisha Komatsu Seisakusho, Tokyo, Japan

[21] Appl. No.: 411,772

[22] PCT Filed: Sep. 30, 1993

[86] PCT No.: PCT/JP93/01402

§ 371 Date: Mar. 30, 1995

§ 102(e) Date: Mar. 30, 1995

[87] PCT Pub. No.: WO94/08098

PCT Pub. Date: Apr. 14, 1994

[30] Foreign Application Priority Data

Sep. 30, 1992 [JP] Japan ..... 4-283538

[51] Int. Cl.[6] ..... E02F 3/38

[52] U.S. Cl. ..... 414/694; 414/685

[58] Field of Search ..... 414/685, 687, 414/694, 722

[56] References Cited

U.S. PATENT DOCUMENTS

| | | | |
|---|---|---|---|
| 3,465,904 | 9/1969 | Pensa | 414/694 |
| 3,536,216 | 10/1970 | Brownwell | 414/694 |
| 3,792,786 | 2/1974 | Goikhburg et al. | 414/694 |
| 3,952,890 | 4/1976 | Armstrong | 414/694 |
| 4,185,945 | 1/1980 | Gill | 414/694 |
| 4,393,607 | 7/1983 | Hirosawa | 414/687 |
| 5,266,001 | 11/1993 | Kanayama et al. | 414/694 |
| 5,423,655 | 6/1995 | Kanayama et al. | 414/694 |

FOREIGN PATENT DOCUMENTS

| | | |
|---|---|---|
| 0399043 | 11/1990 | European Pat. Off. . |
| 53-30105 | 3/1978 | Japan . |
| 64-66319 | 3/1989 | Japan . |
| 2-8419 | 1/1990 | Japan . |
| 4-155022 | 5/1992 | Japan . |

*Primary Examiner*—Karen B. Merritt
*Assistant Examiner*—Gregory A. Morse
*Attorney, Agent, or Firm*—Sidley & Austin

[57] ABSTRACT

A working tool unit of a construction machine, which excels in transportability and is capable of smoothly carrying out diversified types of work in a wide range, is disclosed. Therefore, the working tool unit according to the present invention includes: a first boom (31*a*) rockably mounted on a turning frame of a vehicle body; a second boom (3*b*) mounted to be rockable on the first boom; an arm (32) mounted to be rockable on the second boom; a working tool such as a bucket (33) mounted on said arm; a first boom cylinder (35) mounted on the turning frame (21) and the second boom to rock the second boom; a second boom cylinder (36) mounted on the second boom and the first boom to rock the second boom; and an arm cylinder (37) mounted on the second boom and the arm to rock the arm. The working tool unit is adapted to switch over its position from an attitude for storage to an attitude for working by rocking the first boom (31*a*) with extension and contraction of the first boom cylinder (35) and the second boom cylinder (36).

21 Claims, 13 Drawing Sheets

WORKING TOOL UNIT OF CONSTRUCTION MACHINE

FIELD OF THE INVENTION

The present invention relates to a working tool unit of a construction machine provided with a working tool such as, for example, a bucket at a front side of a cab.

BACKGROUND OF THE INVENTION

A construction machine having a working tool unit, such as a bucket at a front side of a cab as shown in FIG. 12, comprises booms 101 which are rockingly mounted, an arm 102 which is rockingly mounted on the booms 101; a working tool unit 100 such as, for example, a bucket 103 installed on the arm 102; boom cylinders 104; an arm cylinder 105 or a bucket cylinder 106 operated by an operator, whereby the working tool unit is actuated to carry out work. However, the attitude of such construction machine during transportation is unstable and adversely affects the efficiency of transportation because its overall length L and overall height H are large and its center of gravity is deviated. Moreover, visibility during travel is unsatisfactory. Therefore, those inventions disclosed in Japanese Patent Application Disclosure SHO. 53-30105 and SHO. 64-66319 have been proposed. An arm of a working tool unit disclosed in Japanese Patent Application Disclosure SHO. 53-30105 is accommodated for transportation by being positioned past a dead center located beyond a working position limit and being collapsed right above the vehicle body and at a side of the cab. For transporting the working tool unit disclosed in Japanese Patent Application Disclosure SHO. 64-66319, one of the two connector pins for a first boom and a second boom is removed, and the first boom and the second boom are collapsed, one above another, by rotating first boom rearwardly at the side of the cab. For working, the connector pin, which had been removed, is installed again, and the first and second booms are operated as a single integrated boom.

The working tool unit disclosed in Japanese Patent Application Disclosure SHO. 53-30105 has insufficient stability during transportation, since its overall height is high and therefore its center of gravity is also positioned high, because the working tool unit is folded right above the vehicle machine. In addition, when the working tool unit is halted to be inoperable at the upper dead point, there is a problem unless a specific control or an operation using the inertia of the working tool unit is performed, since the first boom cylinder passes through the upper dead point during switching over from a state of storage to a state of working.

The working tool unit disclosed in Japanese Patent Application Disclosure SHO. 64-66319 requires the removal and remounting of the connector pin each time the attitude of the working tool unit needs to be changed from a working attitude to a transportation attitude or from a transportation attitude to a working attitude, and therefore the work for changing the attitude is troublesome and requires a number of man-hours. If the operation is faulty when the connector pin is installed for changing the attitude of the working tool unit from a transportation attitude to a working attitude, the bucket is disengaged from any bucket engagement device, since a cylinder is not provided between the first boom and the second boom, although the bucket can be properly engaged with the bucket engagement device and the booms can be normally extended and contracted if the boom cylinders and the arm cylinder are simultaneously operated in position. In this case, the first boom and the second boom, which are connected only with one connector pin, can never be operated, and the position of the working tool unit can neither be changed to the transportation attitude nor to the working attitude unless it is supported by a crane.

In addition, lately the traffic congestion has been more intensified due to the increase in the number of vehicles, and an improvement of transportation efficiency has been strongly demanded. Particularly, it has been demanded that construction machines, which need to travel by themselves to working sites, be capable of traveling at higher speeds. In this case, it is also demanded that the construction machines have stability in high speed travel, turning performance, reduction of overall length, satisfactory visibility, and smaller turning circle.

DISCLOSURE OF THE INVENTION

An object of the present invention made in view of the above-described problems is to provide an improved working tool unit which excels in transportability and smooth operation in a wide range of work on a construction machine equipped with the working tool at the front side of the cab.

A working tool unit of a construction machine having a working tool at the front side of the cab according to the present invention comprises: a first boom rockingly mounted on a turning frame of a vehicle body; a second boom rockingly mounted on the first boom; an arm rockingly mounted on the second boom; a working tool, such as a bucket, mounted on the arm; a first boom cylinder mounted on the turning frame of the vehicle body and the second boom to rock the second boom; a second boom cylinder mounted on the second boom and the arm to rock the second boom; and an arm cylinder mounted on the second boom and the arm to rock the arm. As shown in first, second, third and fourth embodiments (see FIGS. 1, 8, 9 and 10), in a storing attitude of the working tool unit, the second boom is provided with a pin for mounting the first boom cylinder, which connects the turning frame of the vehicle body and one end of the second boom, at a position above a line between a boom support pin on the turning frame of the vehicle body and a pin for connecting the first boom and the second boom; and a pin at the second boom side of the second boom cylinder, for connecting the first boom and the second boom, is set so that the second boom cylinder is not positioned across the above-described line. When changing the attitude of the working tool unit from the storing attitude to the working attitude or from the working attitude to the storing attitude, the first boom cylinder is extended or contracted and simultaneously the second boom cylinder is contracted or extended.

As shown in a fifth embodiment (see FIG. 11), in the storing attitude of the working tool unit, the second boom is provided with a pin for mounting the first boom cylinder which connects the turning frame of the vehicle body and one end of the second boom, at a position above a line between a boom support pin on the turning frame of the vehicle body and a pin for connecting the first boom and the second boom in a storing attitude of the working tool unit; and a pin at the second boom side of the second boom cylinder, for connecting the first boom and the second boom, is set so that the second boom cylinder is positioned across the above-described line. When changing the attitude of the working tool unit from the storing attitude to the working attitude or from the working attitude to the storing attitude, the first boom cylinder is extended or contracted and simultaneously the second boom cylinder is contracted or extended. In addition, in the storing attitude of the working tool unit, an angle A, formed by the line between the pin for mounting the first boom cylinder on the turning frame of the vehicle body and the boom support pin for mounting the first boom on the turning frame of the vehicle body and the line between the pin for mounting the first boom cylinder on the turning frame of the vehicle body and the pin for connecting the first boom cylinder and the second boom, is set to be 0 (zero) or larger.

In a construction as described above, when a hydraulic oil is supplied to a rod side of the second boom cylinder and a bottom side of the first boom cylinder for changing the attitude of the working tool unit from the storing attitude to the working attitude in the first, second, third and fourth embodiments, the second boom cylinder is operated in a direction of contraction and the first boom cylinder is operated in a direction of extension. In this case, the front end of the working tool unit is restricted by a bucket engagement device to be unmovable, the first boom pivots in a raising direction, the cylinders are not inoperable at the upper dead point, and the boom smoothly operates in a full range of directions. Also in case of the fifth embodiment, the first and second booms are operated, as in the above embodiments, by supplying the hydraulic oil to the bottom side of the second boom cylinder and the bottom side of the first boom cylinder.

Since the second boom cylinder is connected between the first boom and the second boom, the bucket will not be disengaged from the bucket engagement device, and the working tool unit will not be uncontrollable due to faulty operation when raising the booms.

When the first boom cylinder is operated for extension while the second boom cylinder is operated for contraction, the working tool unit is kept afloat away from the bucket rest, since the angle A in the storing attitude is larger than zero. When the operation of the first boom cylinder is stopped in this state, the first boom is pivoted in the raising direction by a contracting operation of the second boom cylinder. In this case, the bucket engagement device is unnecessary, and the working tool unit will not be uncontrollable.

In addition, the angle between the first boom and the second boom can be set as required by the second boom cylinder, and therefore the working tool unit is applicable to the following diversified types of work:

(1) Moving along an extremely small turning circle with an extremely small turning radius.

(2) Moving in a low height attitude on a small turning circle with the small turning radius.

(3) Performing heavy-duty excavating in which a large lifting load of the bucket is taken.

(4) Performing an enlargement of a work range in which a large excavating radius is taken.

(5) Performing excavating, upper swivel loading, and returning swivel without collision with other obstacles if the angle between the first boom and the second boom is preset when the working radius is limited.

The working tool unit is constructed to be collapsible to reduce the overall length and therefore transportability, visibility, swivelability and small radius turnability during traveling or transportation can be improved. Furthermore, since the overall height of the working tool unit is reduced and the center of gravity is set with less deviation, the stability is improved and the traveling speed can be increased.

BEST MODE FOR CARRYING OUT THE INVENTION

Figure 1:
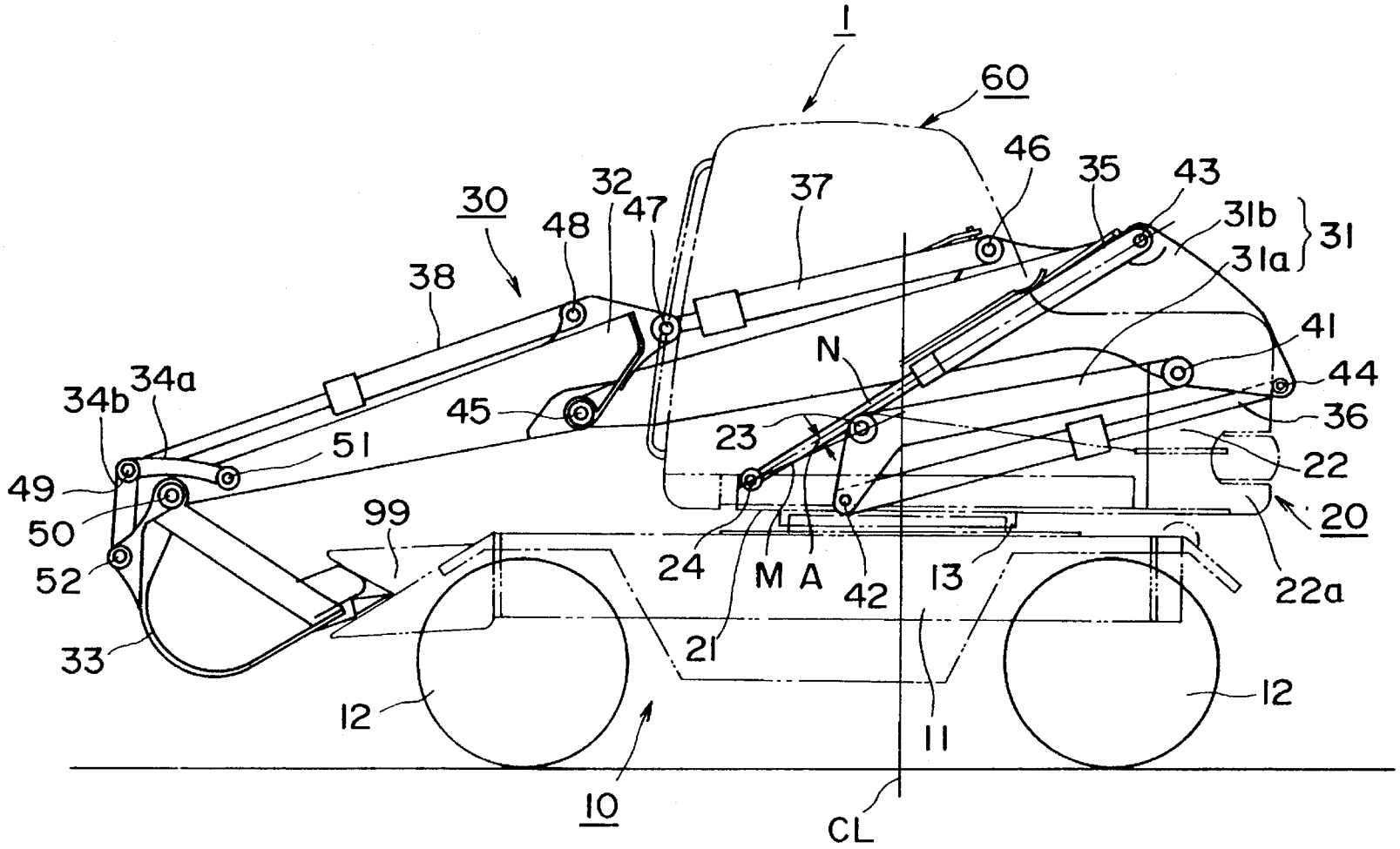
FIG. 1 is a side view of a working tool unit of a construction machine according to the first embodiment of the present invention.

A first embodiment according to the present invention is described in detail, referring to FIGS. 1 to 4. FIG. 1 shows a side view of a working tool unit of a construction machine according to the first embodiment.

A construction machine 1 comprises a lower traveling body 10, an upper swivel body 20 mounted on the lower traveling body 10 to be turnable about a fulcrum CL at an approximate center of the lower traveling body 10, a working tool unit 30 mounted on the upper swivel body 20 to be tiltable in reference to the upper swivel body 20, and a cab 60.

The lower traveling body 10 comprises a lower frame 11, having four wheels 12 which are driven by a hydraulic motor for traveling, not shown, mounted on the lower frame 11 to move the construction machine, and a swivel bearing 13 which is provided on the lower frame 11 to support the upper swivel body 20. The wheels 12 can be an endless track shoe.

The upper swivel body 20 comprises a turning frame 21, supported by the swivel bearing 13, and a swivel base cover 22 including a counterweight **22*a*, and is mounted to be horizontally turnable in reference to the center of swivel CL which is located at an approximate center in the widthwise direction and the longitudinal direction of the lower frame 11 of the lower traveling body 10. The upper swivel body 20 is swiveled by the hydraulic motor for swiveling, not shown, which is driven by the operator in the cab 60. On the upper swivel body 20, a boom support pin 23, for supporting the working tool unit 30 so as to be tiltable in reference to the upper swivel body 20, is attached to the turning frame 21. The swivel base cover 22 is attached to the turning frame 21**.

On the upper swivel body 20, a pin 24, for supporting an end of a first boom cylinder 35 which operates a second boom 3l*b*, described later, of the working tool unit 30 so as to be tiltable as required, is mounted on the turning frame 21. Though not shown, the upper swivel body 20 is provided, inside the swivel base cover 22, with the hydraulic motor of the construction machine 1 or the changeover valves for the cylinders, which are used for the extension and contraction of the working tool unit 30.

The working tool unit 30 comprises a boom 31, consisting of collapsible first boom 31*a* and second boom 31*b*; an arm 32; a bucket 33; bucket links 34*a* and 34*b*, which are connected to the arm 32 and the bucket 33; a first boom cylinder 35; a second boom cylinder 36; an arm cylinder 37; a bucket cylinder 38; and connector pins 49, 50, 51 and 52 for coupling respective members and the cylinders.

It is shown that, for example, a pin 41 for coupling the first boom 31*a* and the second boom 31*b* comprises a coupling pin fixed to the first boom 31*a* and a bushing inserted into a hole provided in the second boom 31*b* or comprises, on the contrary, a coupling pin fixed to the second boom 31*b* and a bushing inserted into a hole provided in the first boom 31*a*. Preferably, the construction of the coupling parts can be such that one of the coupling parts for the members is forked and the other coupling part is inserted into this fork, but the coupling parts are not limited to this construction and can be formed as a modification. The construction is the same with other pin parts as described above.

The first boom 31*a* is mounted to be rockable on the turning frame 21 with the boom support pin 23, and is provided with a second boom support pin 41 and a pin 42 which supports a second boom cylinder 36, described later, below the boom support pin 23.

The second boom 31*b* is rockably mounted by the second boom support pin 41 on the first boom 31, and is provided with a pin 43 for mounting one end of the first boom cylinder 35, which connects the turning frame 21 and the second boom 31*b*, at a location above a line between the boom support pin 23 of the turning frame 21 and the pin 41 for coupling the first boom 31*a* and the second boom 31*b*. A pin 44 at the second boom 31*b* end of the second boom cylinder 36, for connecting the first boom 31*a* and the second boom 31*b*, is set not to traverse the above-described line. In addition, the second boom 31*b* has an arm support pin 45 and a pin 46 for supporting the arm cylinder 37.

The arm 32 is rockably mounted by the arm support pin 45 on the second boom 31*b*, and is provided, at the end having the arm support pin 45, with a pin 47 for mounting the arm cylinder 37, which connects the arm 32 and the second boom 31*b*, and a pin 48 for mounting the bucket cylinder 37, which connects the arm 32 and the bucket links 34*a* and 34*b*. The other end of arm 32, opposite the arm support pin 45 end, has a bucket support pin 50, for supporting the bucket 33, and a bucket link support pin 51, for supporting the bucket link 34*a*.

The bucket 33 is rockably mounted by a bucket support pin 50 on the arm 32, and is provided with a bucket link support pin 52 for connecting with the bucket link 34*b*. The bucket 33 is held by the lower frame 11 when the working tool unit 30 is in the storing attitude. The bucket link 34*a* is rockably mounted by a bucket support pin 51 on the arm 32, and is connected with the bucket link 34*b* by a pin 49. The bucket cylinder 38 is also connected to this pin 49.

The first boom cylinder 35 is secured at its rod end by the pin 24 on the turning frame 21, and at its case end by the pin 43 on the second boom 31*b*, to connect the turning frame 21 and the second boom 31*b*. The second boom cylinder 36 is secured at its case end by the pin 42 on the first boom 31*a*, and at its rod end by the pin 44 of the second boom 31*b*, to connect the second boom 31*b* and the first boom 31*a*.

The arm cylinder 37 is secured at its case end by the pin 46 on the second boom 31*b*, and at its rod end by the pin 47 on the arm 32, to connect the second boom 31*b* and the arm 32. The bucket cylinder 38 is secured at its case end by the pin 48 on the arm 32, and at its rod end by the pin 49 of the bucket links 34*a* and 34*b*, to connect the arm 32 and the bucket 33 with the bucket link 34*b*. Pins 23 and 24 are fixed pins mounted on the turning frame 21. In this case, there is no problem if the case end and the rod end are reversely arranged.

In the storing attitude, if an angle A formed by a line M between the pin 24 on the turning frame 21 of the vehicle body, for mounting the first boom cylinder 35, and the boom support pin 23, for mounting the first boom 31*a* on the turning frame 21, and a line N between the pin 24 and the pin 43, for connecting the first boom cylinder 35 and the second boom 31*b*, is set to be larger than zero, the raising and lowering operations can be further smoothed. As illustrated in FIGS. 1 and 8–11, when the angel A is zero, the boom support pin is on the line between the pin for mounting the first boom cylinder on the turning frame of the vehicle body and the pin for connecting the first boom cylinder and the second boom, and when the angel A is larger than zero, the boom support pin is below that line. As in the conventional example, the bucket engagement device 99 can be arranged in front of the vehicle body.

The cab 60 is installed on the turning frame 21 beside the working tool unit 30, and operation levers, not shown, for commanding the operations of the working tool unit, are provided inside the cab 60.

Operations of the working tool unit 30 in the above-described construction are described below.

In the storing attitude (transportation attitude) shown in FIG. 1, the overall height of the working tool unit 30 is lower than that of the conventional unit disclosed in Japanese Patent Application Disclosure SHO. 53-30105, and therefore the center of gravity of the whole vehicle body is lower. For this reason, the stability of the construction machine during traveling on a sloped ground or a curved road is increased, and the construction machine can travel at a high speed. Compared with Japanese Patent Application Disclosure SHO. 64-66319, the working tool unit according to the present invention is coupled to the construction machine with members such as the boom 31 and the arm 32 and with cylinders 35, 36, 37 and 38, and the coupling parts are firmly jointed, and therefore the stability is further improved. Even if the construction machine vehicle vibrates during traveling, it can travel at a high speed owing to such firm joint of coupling and connecting parts and to improved resistance to vibration of the vehicle resulting from the arrangement of the bucket on the lower traveling body.

Figure 2:
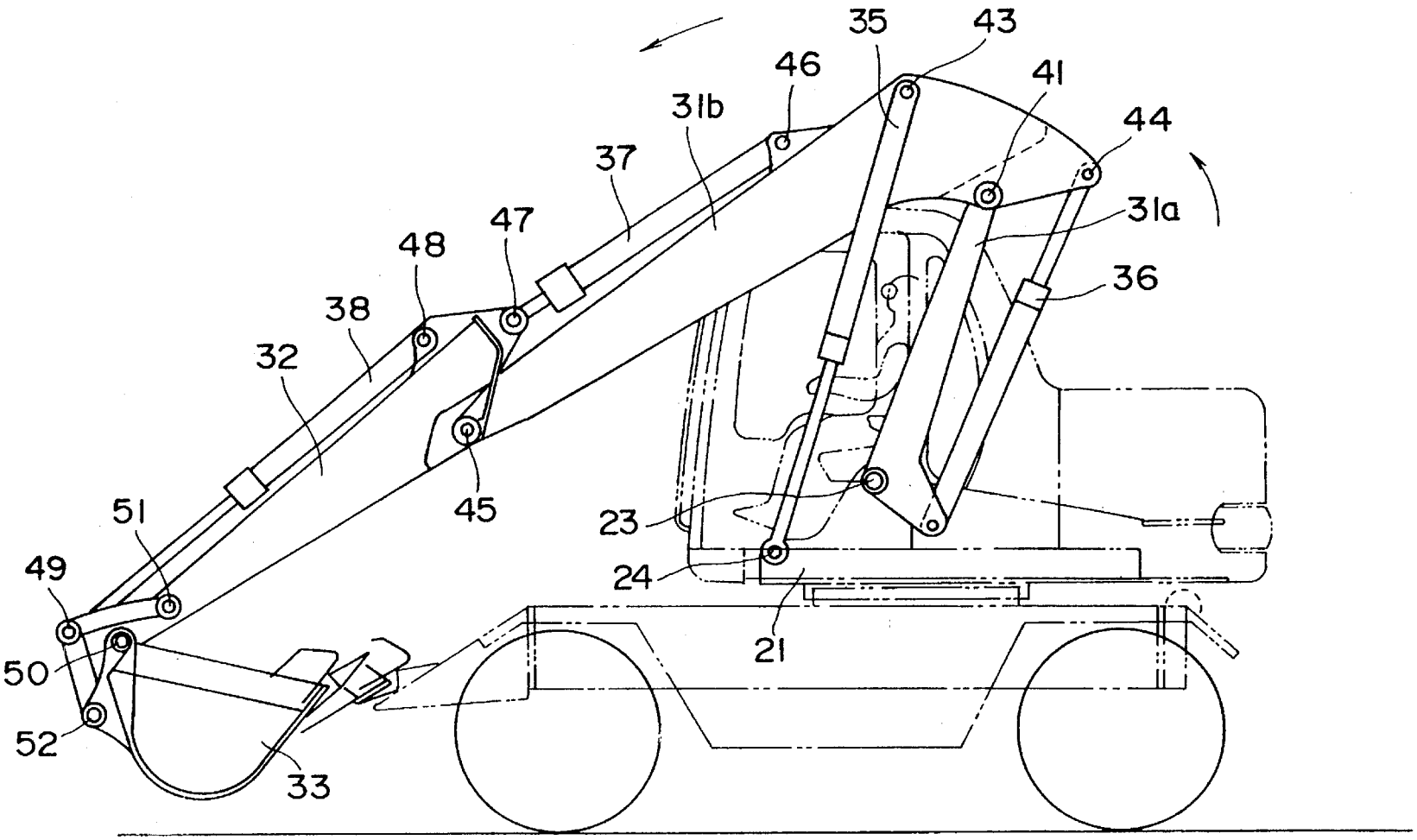
FIG. 2 is a diagram illustrating a behavior of the working tool unit in switching over from the storing attitude (or transportation attitude) shown in FIG. 1 to the working attitude.

For changing over the attitude of the working tool unit from the storing attitude (transporting attitude) to the working attitude, the operator actuates operation levers, not shown, for the boom lifting direction to generate an upward movement command to the boom 31. Along with this operation, the first boom cylinder 35 is extended and the second boom cylinder 36 is contracted. At this time, a force acts on the second boom 31*b* for clockwise rotation about the pin 41, which connects the first boom 31*a* and the second boom 31*b*, while a force acts on the first boom 31*a* for counterclockwise rotation about the pin 23, which mounts the first boom 31*a* on the turning frame 21. Thus, as shown in FIG. 2, the first boom 31*a* is smoothly rotated and raised and simultaneously the second boom 31*b* is moved forwardly to have the working attitude.

Next, the first boom 31*a* and the second boom 31*b* are stopped at positions suitable for working conditions, and the first boom cylinder 35, the arm cylinder 37 or the bucket cylinder 38 is actuated to carry out excavation, swiveling, and earth removal with the bucket 33. In this case, the work is generally carried out with the second boom 31*b* kept fixed, and a similar operation to the conventional working tool unit is carried out to facilitate working.

Figure 3:
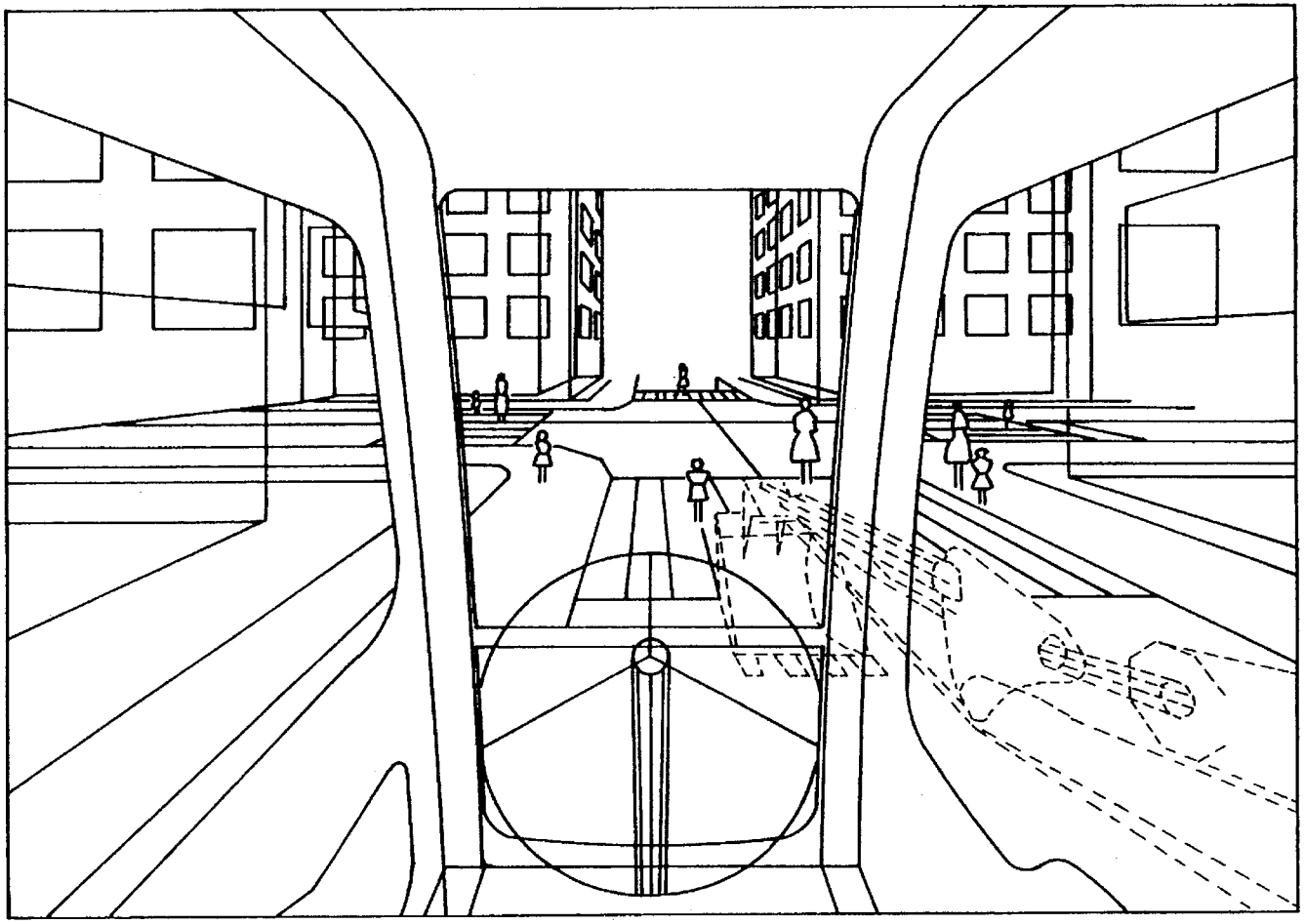
FIG. 3 is a diagram illustrating visibility in the first embodiment.
Figure 13:
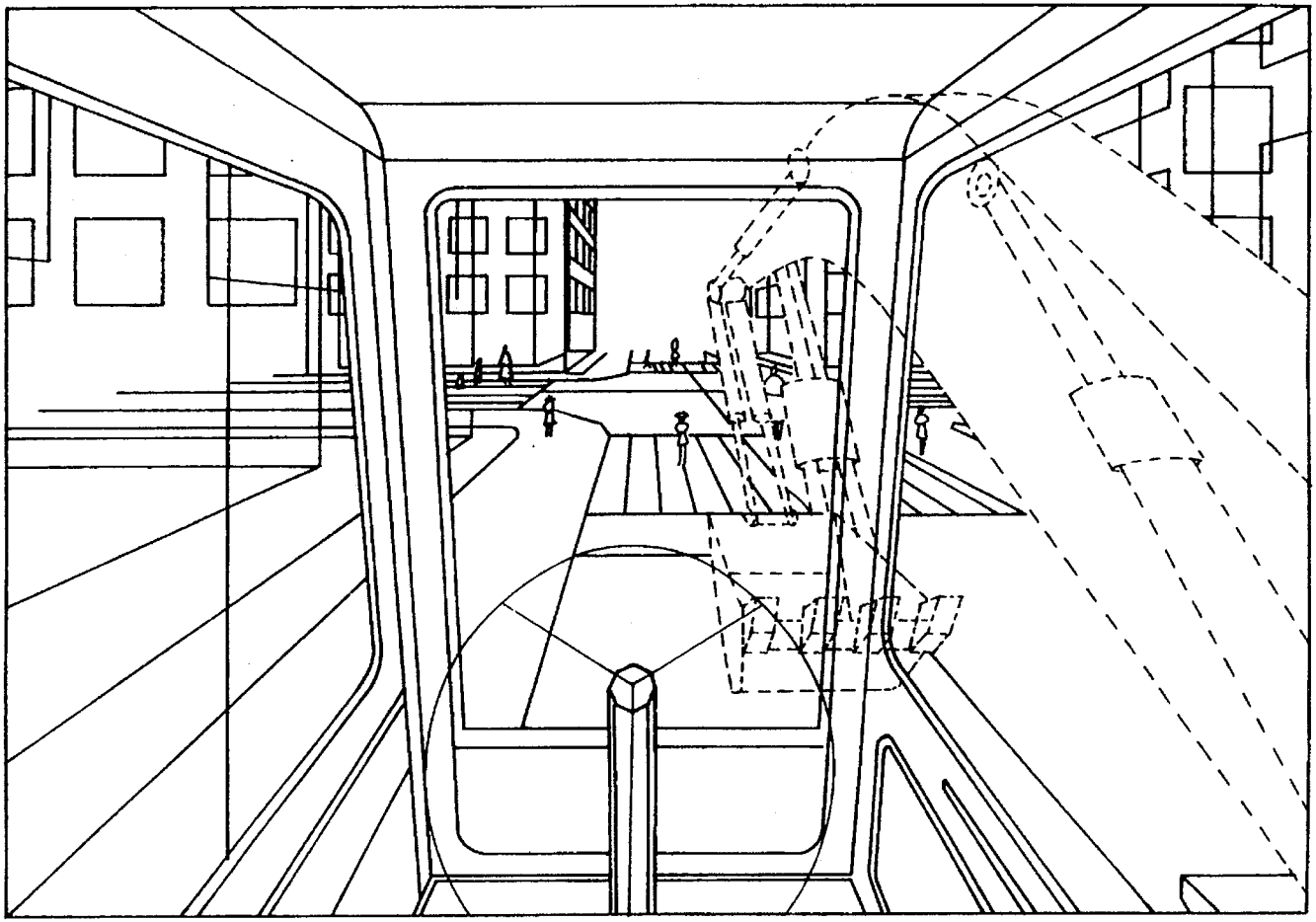
FIG. 13 PRIOR ART
FIG. 13 is a diagram illustrating the visibility of the conventional working tool unit of a construction machine

FIG. 3 shows a visibility in the first embodiment in the forward view from the eye position of the operator on the operator's seat in the cab. The visibility for the forward and right side views from the operator's seat is further improved as compared with the example of the prior art shown in FIG. 13.

The following describes an example of application in which diversified types of work can be carried out since the boom 31 is divided into the first boom 31*a* and the second boom 31*b* which can be collapsed.

Figure 4:
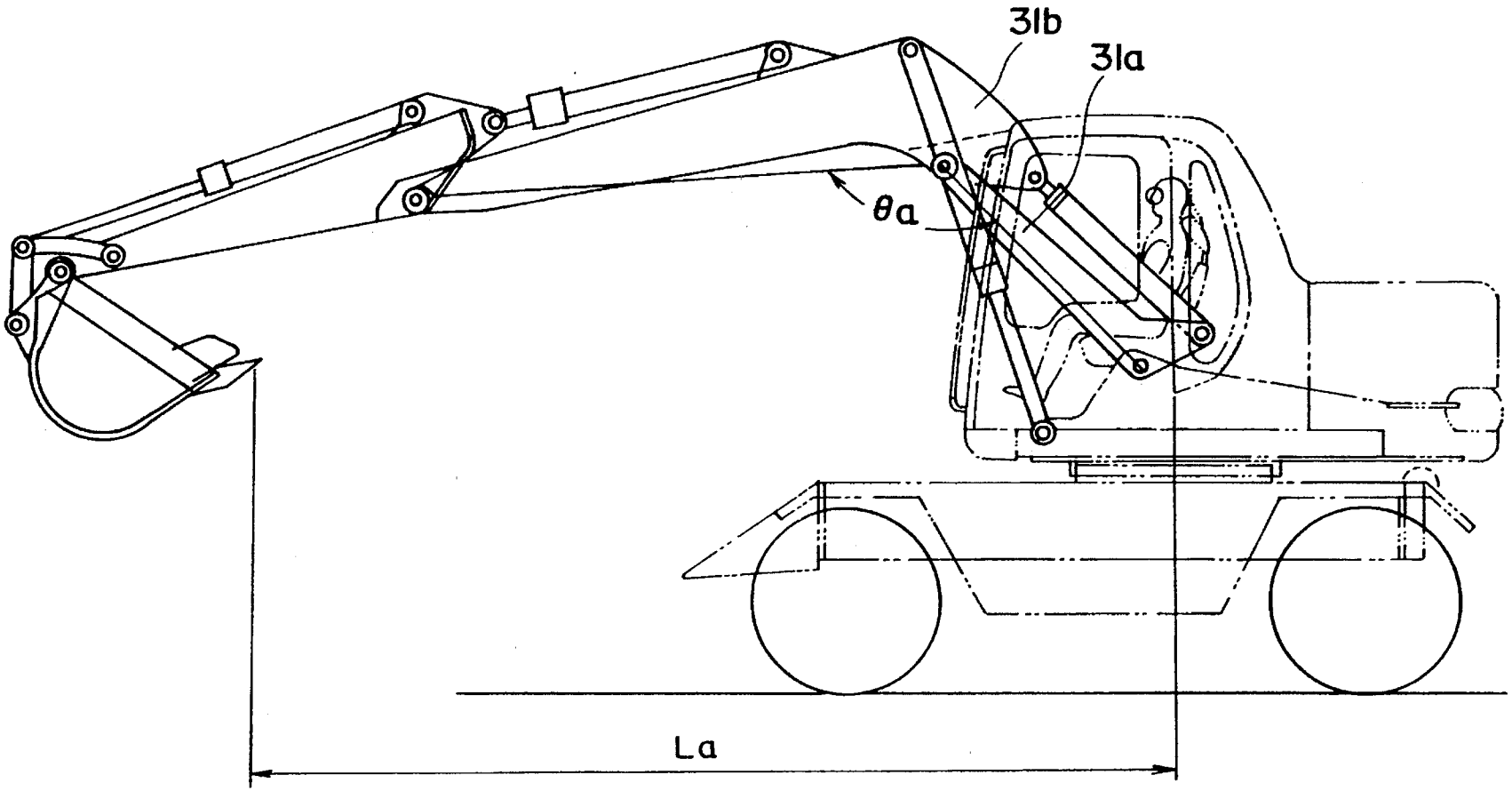
FIG. 4 is a diagram illustrating an extended attitude in the working range of the working tool unit of a construction machine according to the present invention.

FIG. 4 shows an example of an attitude of the working tool unit 30 for an extended range of work. The range La of excavation or earth removal by largely rocking the first boom 31*a* in the front of the vehicle and setting the angle θa formed by the first boom 31*a* and the second boom 31*b* to be larger.

Figure 5:
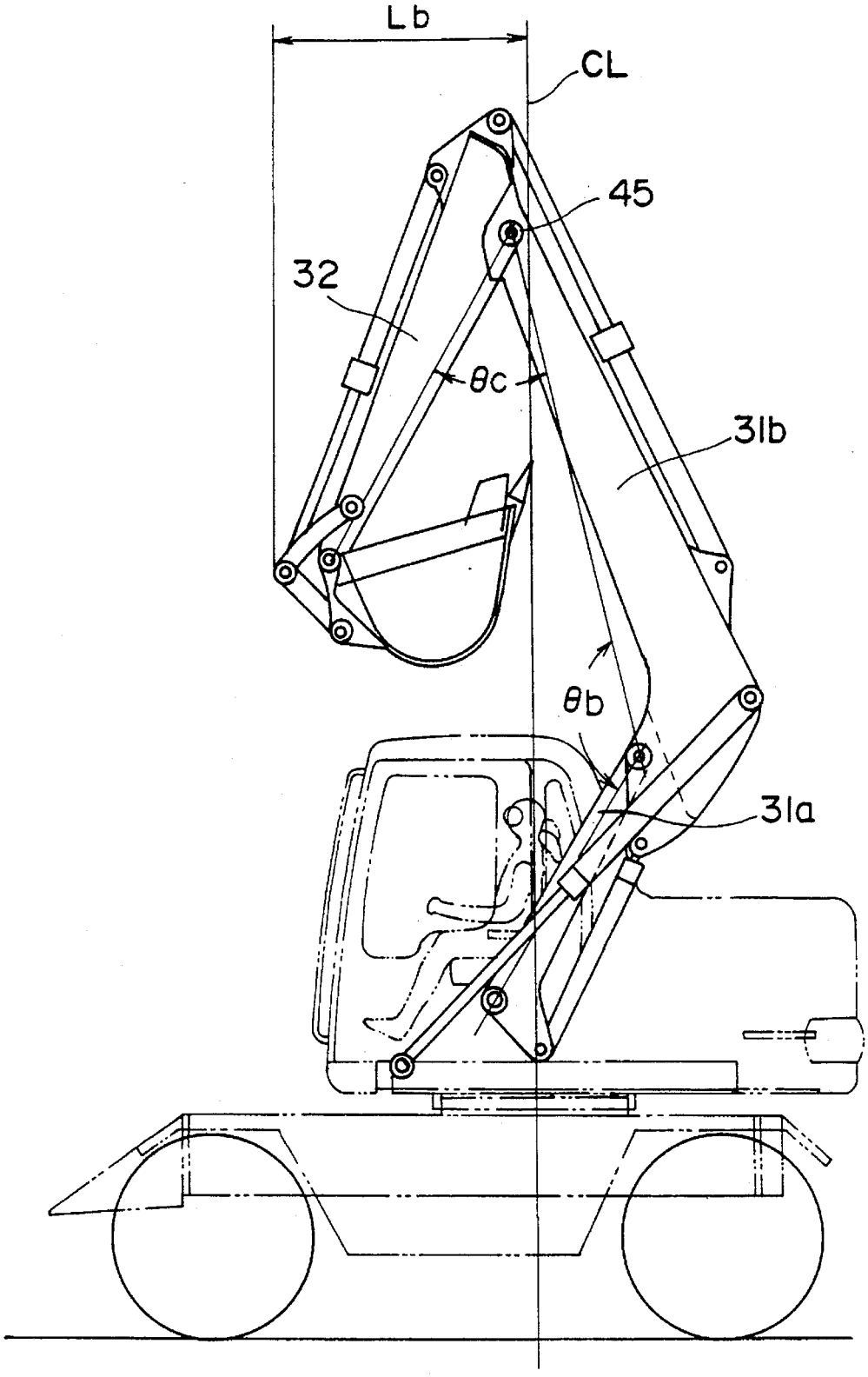
FIG. 5 is a diagram illustrating a super small turning attitude of the working tool unit of a construction machine according to the present invention.

FIG. 5 shows an example of an attitude for super small turning circle in which the first boom 31*a* is rocked at a specified rear position of the vehicle, the angle θb formed by the first boom 31*a* and the second boom 31*b* is set to be larger, and the coupling part (nearby the pin 45) of the second boom 31*b* and the arm 32 is moved to a position near the center CL of swiveling. The radius range Lb of super small turning circle can be reduced to permit super small radius turning by setting the angle θc formed by the second boom 31*b* and the arm 32.

Figure 6:
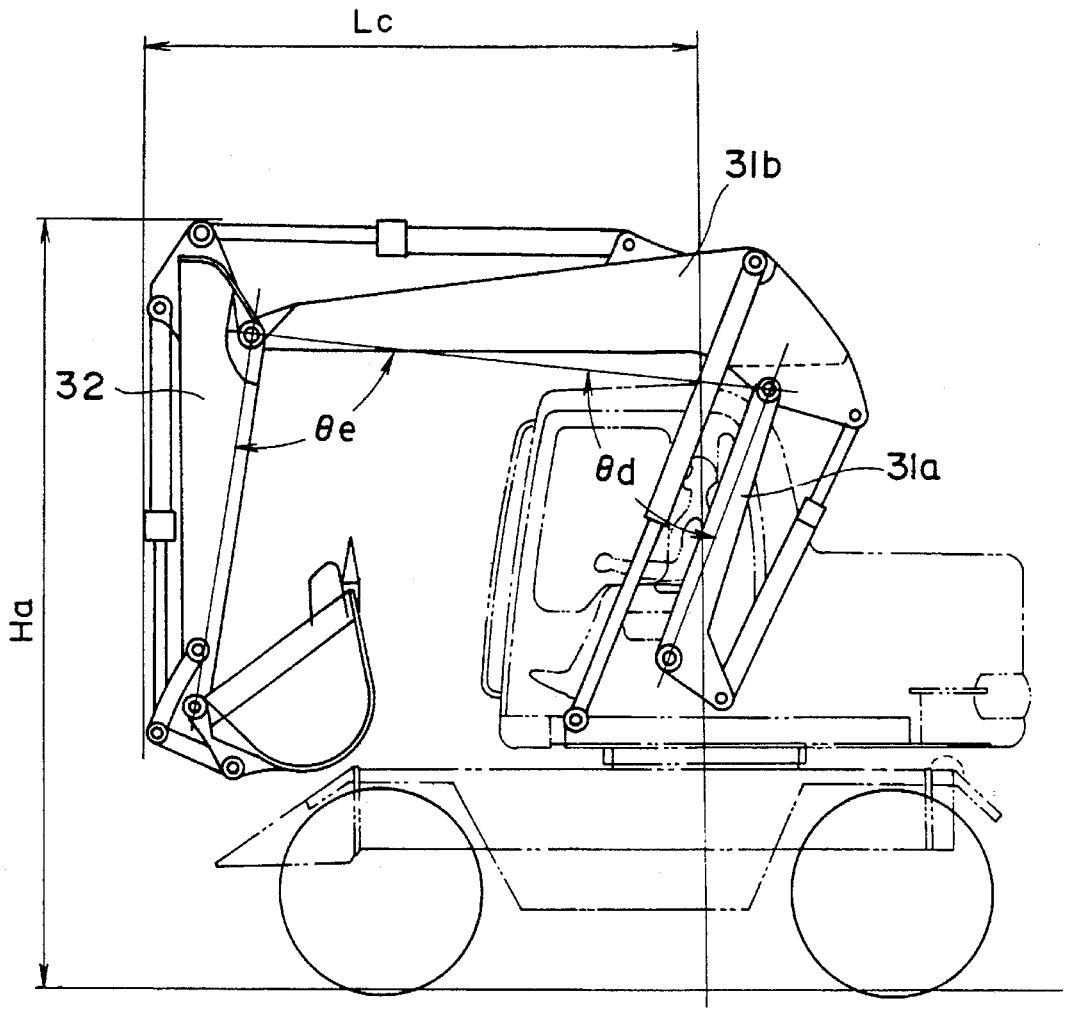
FIG. 6 is a diagram illustrating a small radius turning attitude and a low swiveling attitude of the working tool unit of a construction machine according to the present invention.

FIG. 6 shows examples of small radius turning attitude and low swiveling attitude in which the angle θd formed by the first boom 31*a* and the second boom 31*b*, is set so that the second boom 31*b* is kept substantially parallel to the ground surface and the angle θe, formed by the second boom 31*b* and the arm 32, is set so that the arm 32 is kept substantially normal to the ground surface to enable swiveling of the working tool unit in the attitude with a low height Ha of the booms on a small turning circle with the radius Lc.

Figure 7:
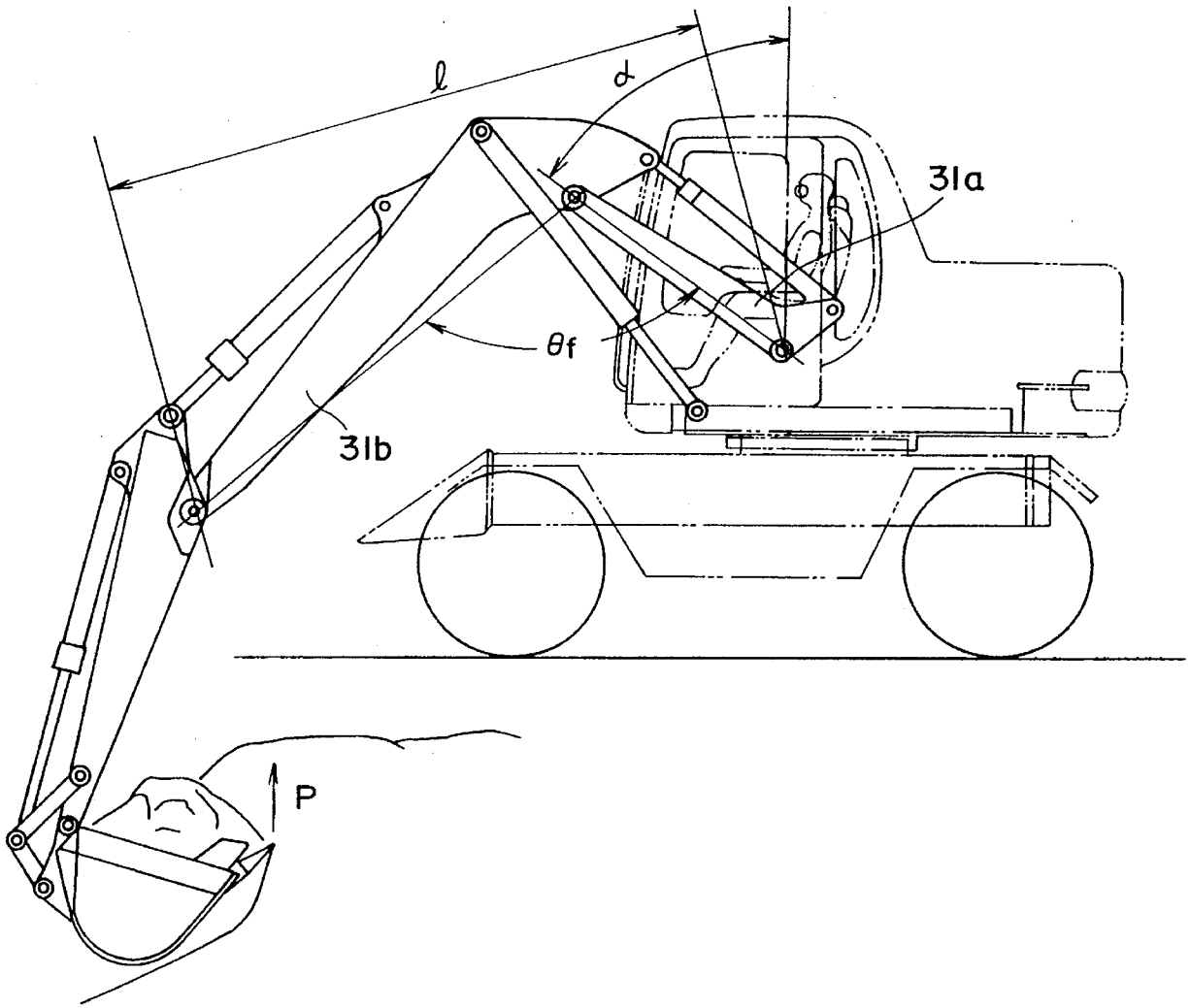
FIG. 7 is a diagram illustrating a heavy-duty excavation attitude of the working tool unit of a construction machine according to the present invention.

FIG. 7 shows an example of the attitude for heavy-duty excavation in which the distance 1 up to the boom top can be reduced and the boom lifting force P can be large by pivoting the first boom 31*a* at a specified degree of angle α in a forward direction of the vehicle and setting the angle θf, formed by the first boom 31*a* and the second boom 31*b*, to be small. Thus heavy-duty excavation can be carried out.

Figure 8:
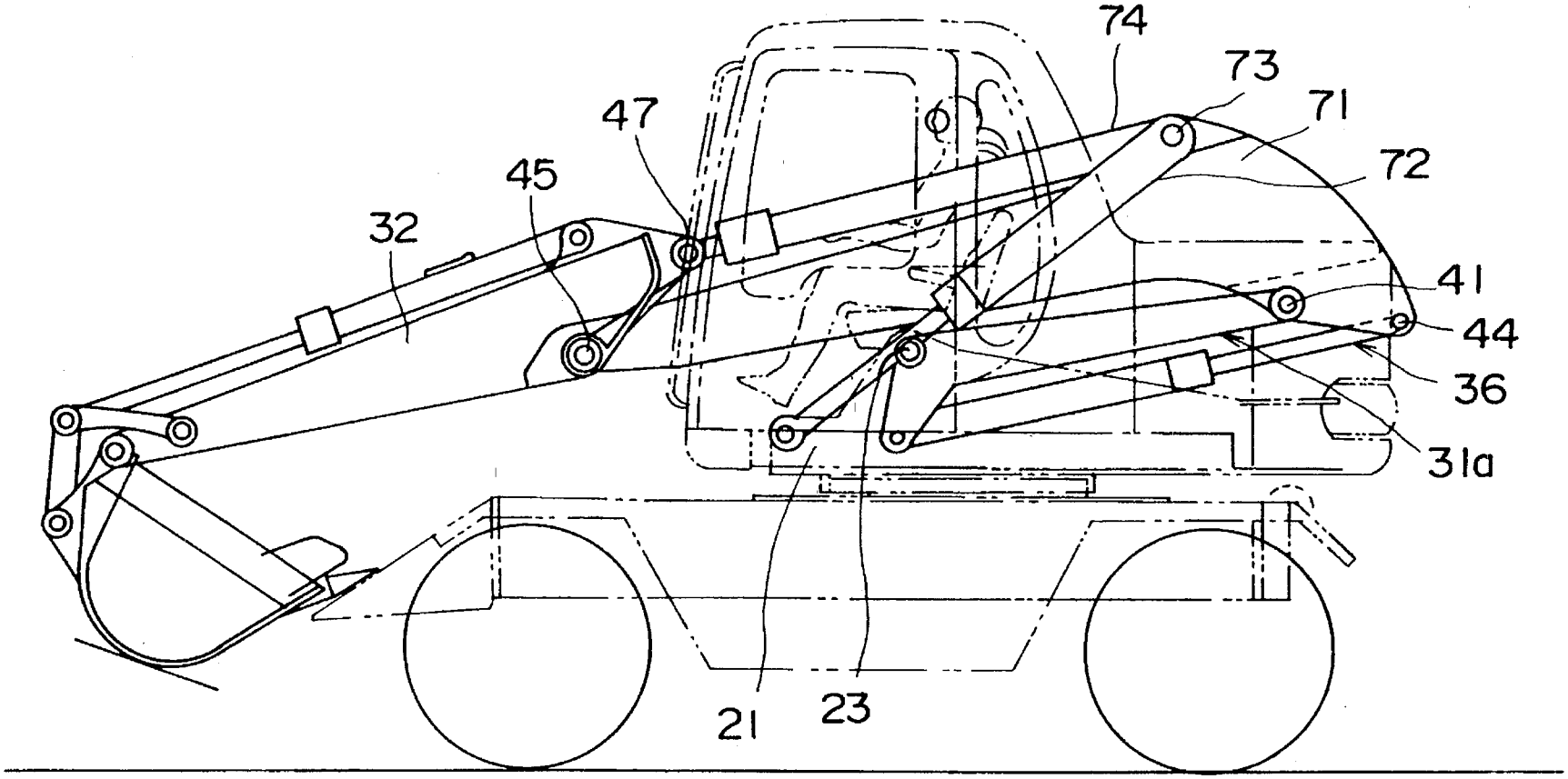
FIG. 8 is a side view of the working tool unit of a construction machine according to the second embodiment.

A second embodiment of the present invention is described, referring to the side view of the working tool unit of a construction machine shown in FIG. 8. Component parts identical to those of the first embodiment are given the same reference numerals, and the example of application and the description thereof are omitted.

In a construction of a second boom 71, a mounting part of a first boom cylinder 72 and an arm cylinder 74 differs from the one of the first embodiment. Specifically, a case end of the arm cylinder 74 is secured to the first boom cylinder 72 by a pin 73, and therefore the construction of the second boom 71 can be simplified. A rod end of the arm cylinder 74 is secured by the pin 47 to the arm 32, as in the first embodiment, and the second boom 71 and the arm 32 are connected. The description of the operation thereof is omitted because it is the same as in the first embodiment.

Figure 9:
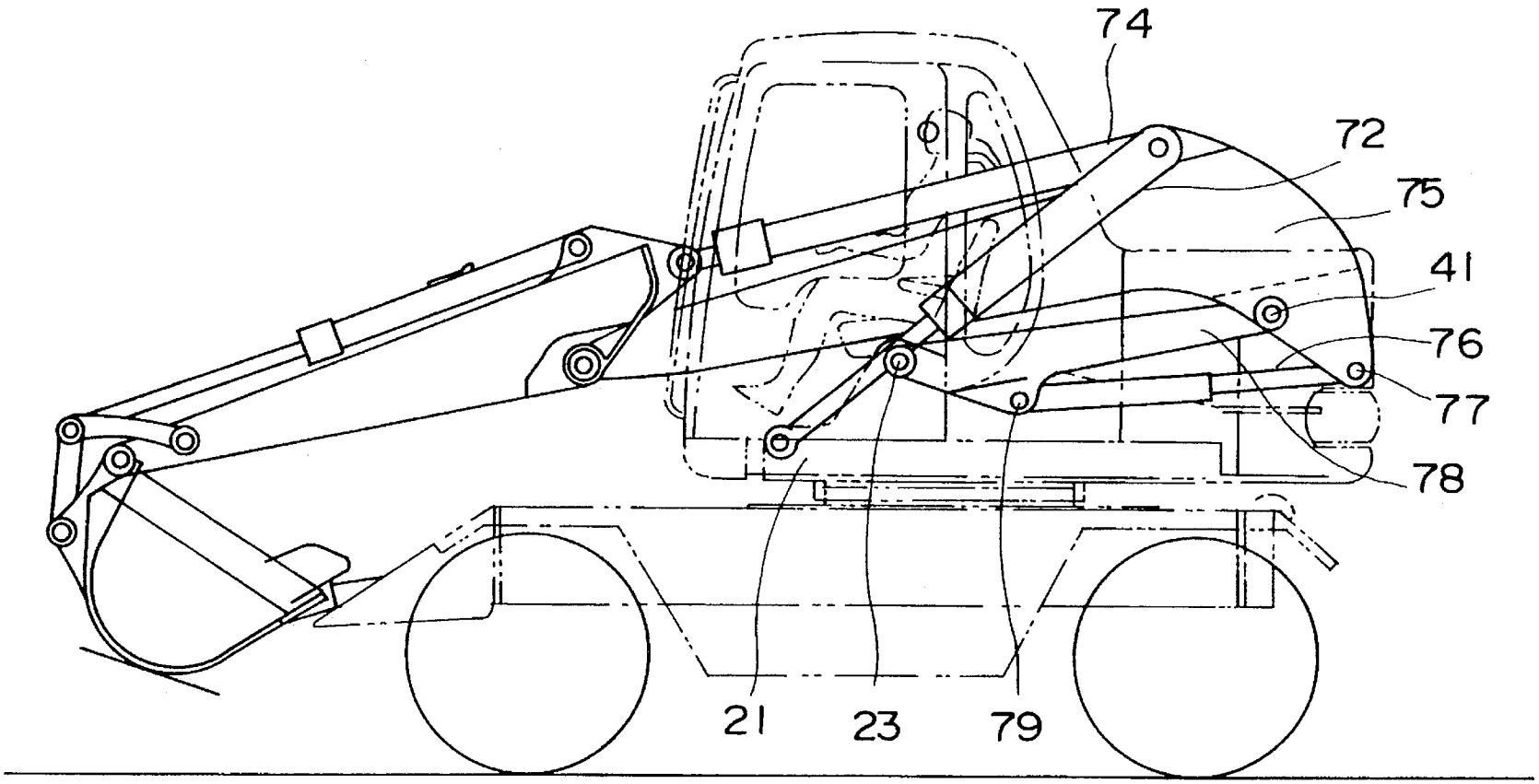
FIG. 9 is a side view of the working tool unit of a construction machine according to the third embodiment.

A third embodiment of the present invention is described referring to the side view of the working tool unit of a construction machine shown in FIG. 9. In a construction of a second boom 75, a mounting part of a first boom cylinder 72 and an arm cylinder 74 is the same as in the second embodiment, but a shape of the mounting part near a pin 77, for mounting the second boom cylinder 76, is different. Specifically, the distance between the pin 41 and the pin 77 for the second boom 75 is set to be larger than the second embodiment, and a stroke of the second boom cylinder 76 is reduced. The shape of the first boom 78 is different from that in the first embodiment and the second boom cylinder 76 is repositioned with respect to the second boom 75 so that the second boom cylinder 76 is below the boom support pin 23 on the turning frame 21. Therefore, the shapes of the first boom 78 and the turning frame 21 are simplified to eliminate interference (overlap) of the first boom 78 and the turning frame 21. The description of the operation thereof is omitted because of being identical to the first embodiment.

Figure 10:
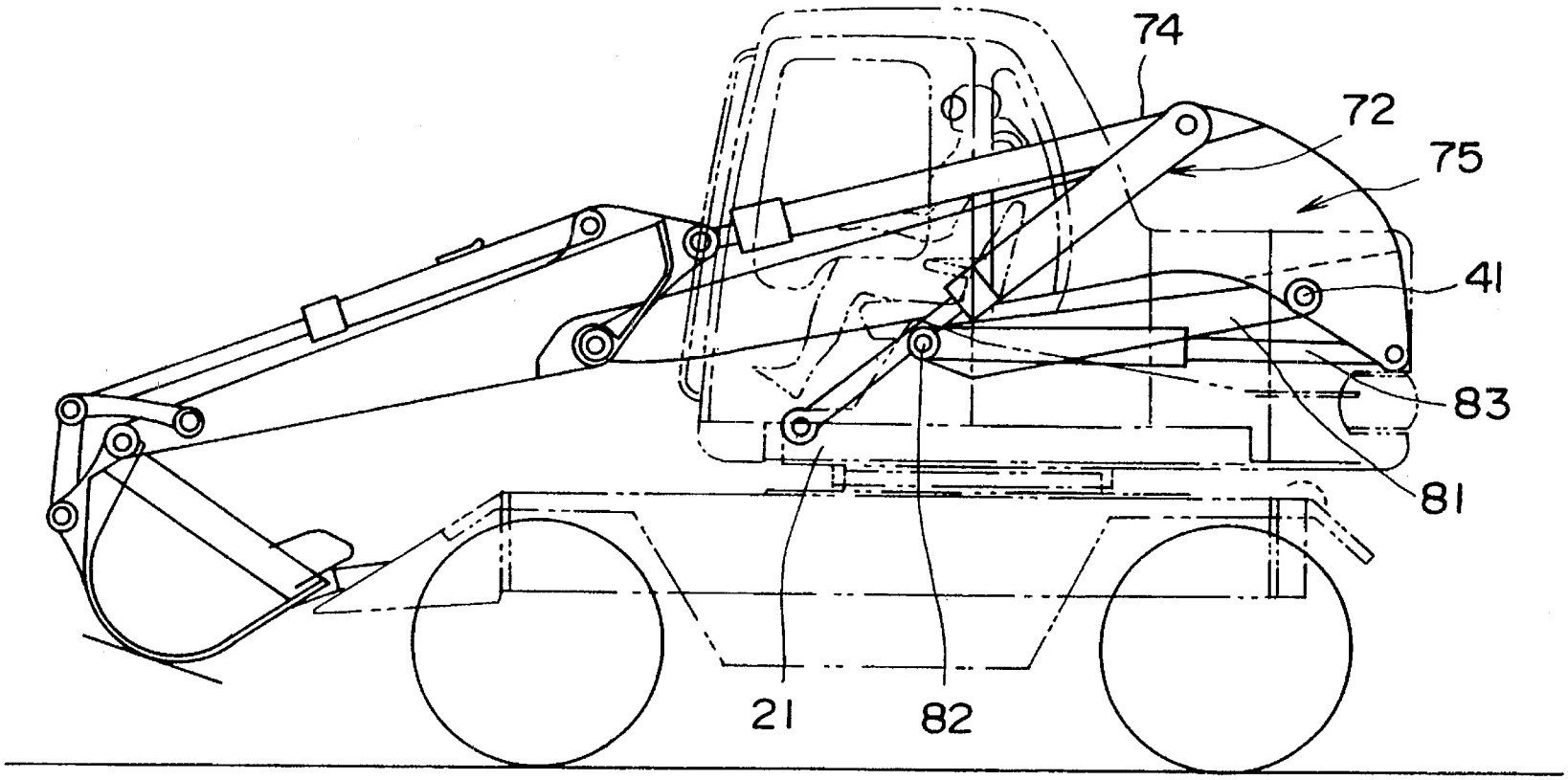
FIG. 10 is a side view of the working tool unit of a construction machine according to the fourth embodiment.

A fourth embodiment of the present invention is described referring to the side view of the working tool unit of a construction machine shown in FIG. 10. In this embodiment, the shape of the second boom 75 is the same as that in the third embodiment, but the shape of a first boom 81 is different.

The first boom 81 is rockably mounted on the turning frame 21 by a boom support pin 82, which also secures a second boom cylinder 83. Besides this, the first boom 81 only has the second support pin 41. Therefore, the shape of the first boom 81 is more simplified than that in the third embodiment. The description of the operation thereof is omitted because of being identical to the first embodiment.

Figure 11:
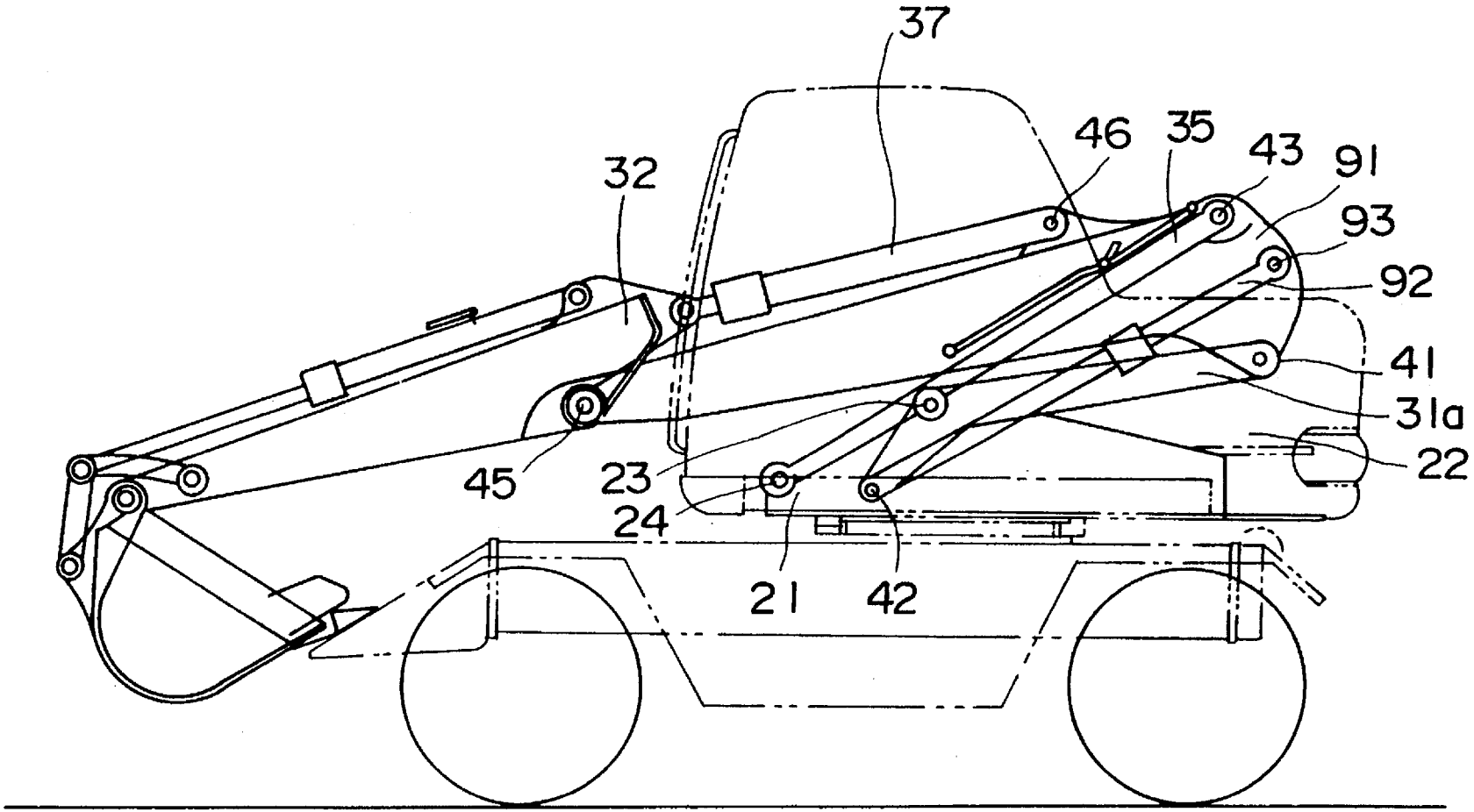
FIG. 11 is a side view of the working tool unit of a construction machine according to the fifth embodiment.
Figure 12:
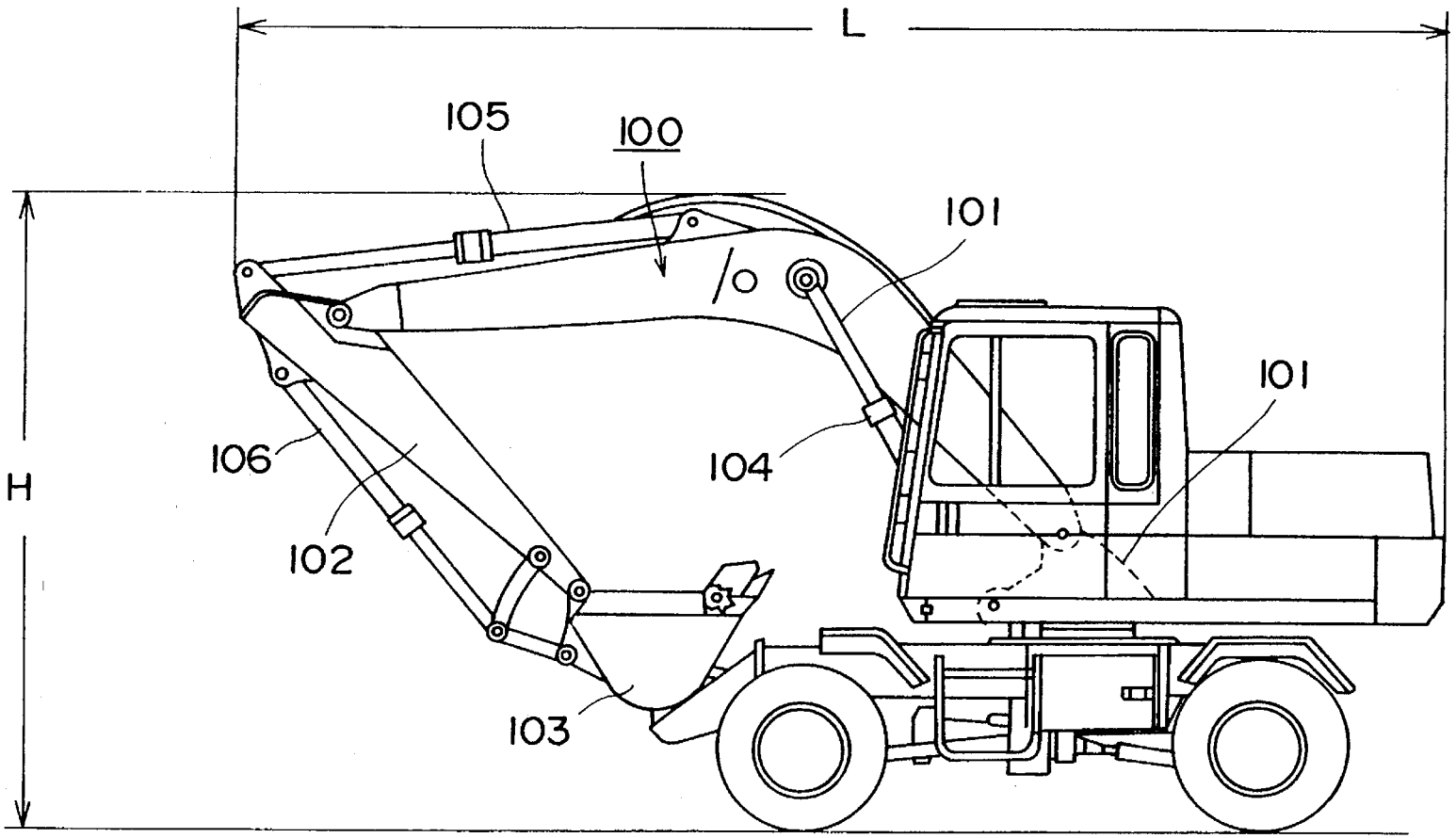
FIG. 12 PRIOR ART
FIG. 12 is a side view of the conventional working tool unit of a construction machine.

A fifth embodiment of the present invention is described referring to the side view of the working tool unit of a construction machine shown in FIG. 11. In this embodiment, the shape of the first boom 31*a* is the same as that in the first embodiment, but the shape of a second boom 91 is different.

The second boom 91 is rockably mounted by the second boom support pin 41 on the first boom 31*a*, and is provided with the pin 43, for mounting the first boom cylinder 35 which connects the turning frame 21 and the second boom 91, at a position above a line between the boom support pin 23, on the turning frame 21, and the pin 41, for coupling the first boom 31*a* and the second boom 91. A second boom cylinder 92 is arranged so that a line between a pin 93, for mounting the second boom cylinder 92 which connects the first boom 31*a* and the second boom 91, and the pin 42, for mounting the second boom cylinder 92 on the first boom 31*a*, traverses the above-described line between pins 23 and 41. Besides this, the second boom 91 has the arm support pin 45 and the pin 46 for supporting the arm cylinder 37.

Thus, the shape of the second boom 91 is more simplified than that in the first embodiment. The description of the operation thereof is omitted because of being identical to the first embodiment.

INDUSTRIAL APPLICABILITY

The present invention is useful as a working tool unit of a construction machine which excels in transportability and is capable of smoothly carrying out diversified types of work in a wide range.

What is claimed is:

1. A working tool unit suitable for being mounted on a turning frame of a construction vehicle so that said working tool unit has a storage attitude and a working attitude, said working tool unit comprising:

a first boom adapted to be rockably mounted on said turning frame;

a second boom rockably mounted on said first boom;

an arm rockably mounted on said second boom;

a working tool mounted on said arm;

a first boom cylinder adapted to be mounted between said turning frame and said second boom to rock said second boom with respect to said turning frame;

a second boom cylinder mounted between said second boom and said first boom to rock said second boom with respect to said first boom;

an arm cylinder mounted between said second boom and said arm to rock the arm;

a boom support pin for rockably connecting said first boom and said turning frame, a first pin rockably connecting said first boom and said second boom, a second pin rockably connecting said second boom and a first end of said first boom cylinder, a third pin rockably connecting a first end of said second boom cylinder to said second boom; and a fourth pin for rockably connecting a second end of said first boom cylinder and said turning frame;

wherein said second pin is located above a first line between said boom support pin and said first pin while said working tool unit is in said storage attitude, and wherein said boom support pin is positioned on or below a second line between said fourth pin and said second pin while said working tool unit is in said storage attitude.

2. A working tool unit in accordance with claim 1, further comprising a working tool cylinder mounted between said arm and said working tool to rock said working tool.

3. A working tool unit in accordance with claim 1, further comprising a fifth pin for rockably connecting a second end of said second boom cylinder to said first boom.

4. A working tool unit in accordance with claim 1, wherein said boom support pin also rockably connects a second end of said second boom cylinder to said first boom.

5. A working tool unit in accordance with claim 1, wherein said third pin is located so that said second boom cylinder does not traverse said first line while said working tool unit is in said storage attitude.

6. A working tool unit in accordance with claim 1, wherein said third pin is located so that said second boom cylinder traverses said first line while said working tool unit is in said storage attitude.

7. A working tool unit in accordance with claim 1, wherein, for switching said working tool unit from said storage attitude to said working attitude, said first boom cylinder is extended while said second boom cylinder is simultaneously contracted.

8. A working tool unit in accordance with claim 1, further comprising a fifth pin connecting a first end of said arm cylinder to said second boom, and a sixth pin connecting a second end of said arm cylinder to said arm.

9. A working tool unit in accordance with claim 1, wherein said second pin also connects a first end of said arm cylinder to said second boom, and wherein a fifth pin connects a second end of said arm cylinder to said arm.

10. A construction machine comprising:

a vehicle body;

a turning frame mounted on said vehicle body for turning movement with respect to said vehicle body; and a working tool unit mounted on said turning frame so that said working tool unit has a storage attitude and a working attitude, said working tool unit comprising:

a first boom adapted to be rockably mounted on said turning frame;

a second boom rockably mounted on said first boom;

an arm rockably mounted on said second boom;

a working tool mounted on said arm;

a first boom cylinder adapted to be mounted between said turning frame and said second boom to rock said second boom with respect to said turning frame;

a second boom cylinder mounted between said second boom and said first boom to rock said second boom with respect to said first boom;

an arm cylinder mounted between said second boom and said arm to rock the arm;

a boom support pin for rockably connecting said first boom and said turning frame, a first pin rockably connecting said first boom and said second boom, a second pin rockably connecting said second boom and a first end of said first boom cylinder, a third pin rockably connecting a first end of said second boom cylinder to said second boom; and a fourth pin for rockably connecting a second end of said first boom cylinder and said turning frame;

wherein said second pin is located above a first line between said boom support pin and said first pin while said working tool unit is in said storage attitude, and wherein said boom support pin is positioned on or below a second line between said fourth pin and said second pin while said working tool unit is in said storage attitude.

11. A construction machine in accordance with claim 10, further comprising a fifth pin for rockably connecting a second end of said second boom cylinder to said first boom.

12. A construction machine in accordance with claim 11, further comprising a cab mounted on said turning frame, wherein in said storage attitude said second boom is collapsed on top of said first boom with said first, second, and third pins being located rearwardly of said boom support pin, said fourth and fifth pins being located forwardly of said boom support pin, and said arm and working tool extending forwardly of said cab.

13. A construction machine in accordance with claim 10, wherein said working tool comprises a bucket, and a bucket cylinder mounted between said arm and said bucket to rock said bucket.

14. A construction machine in accordance with claim 10, wherein said boom support pin also rockably connects a second end of said second boom cylinder to said first boom.

15. A construction machine in accordance with claim 10, wherein said third pin is located so that said second boom cylinder does not traverse said first line while said working tool unit is in said storage attitude.

16. A construction machine in accordance with claim 10, wherein said third pin is located so that said second boom cylinder traverses said first line while said working tool unit is in said storage attitude.

17. A construction machine in accordance with claim 10, wherein, for switching said working tool unit from said storage attitude to said working attitude, said first boom cylinder is extended while said second boom cylinder is simultaneously contracted.

18. A construction machine in accordance with claim 10, further comprising a fifth pin connecting a first end of said arm cylinder to said second boom, and a sixth pin connecting a second end of said arm cylinder to said arm.

19. A construction machine in accordance with claim 10, wherein said second pin also connects a first end of said arm cylinder to said second boom, and wherein a fifth pin connects a second end of said arm cylinder to said arm.

20. A working tool unit suitable for being mounted on a turning frame of a construction vehicle, said working tool unit comprising:

a first boom adapted to be rockably mounted on said turning frame;

a second boom rockably mounted on said first boom;

an arm rockably mounted on said second boom;

a working tool mounted on said arm;

a first boom cylinder adapted to be mounted between said turning frame and said second boom to rock said second boom with respect to said turning frame;

a second boom cylinder mounted between said second boom and said first boom to rock said second boom with respect to said first boom;

an arm cylinder mounted between said second boom and said arm to rock the arm;

a boom support pin for rockably connecting said first boom and said turning frame;

a first pin rockably connecting said first boom and said second boom;

a second pin rockably connecting said second boom and a first end of said first boom cylinder;

a third pin rockably connecting a first end of said second boom cylinder to said second boom;

wherein said working tool unit has a storage attitude and a working attitude;

wherein said second pin is located above a first line between said boom support pin and said first pin while said working tool unit is in said storage attitude; and wherein said third pin is located so that said second boom cylinder does not traverse said first line while said working tool unit is in said storage attitude;

a fourth pin for rockably connecting a second end of said first boom cylinder and said turning frame; and a fifth pin rockably connecting a second end of said second boom cylinder to said first boom;

wherein said second pin also connects a first end of said arm cylinder to said second boom; and wherein a sixth pin connects a second end of said arm cylinder to said arm.

21. A construction machine comprising:

a vehicle body;

a turning frame mounted on said vehicle body for turning movement with respect to said vehicle body;

a cab mounted on said turning frame; and a working tool unit mounted on said turning frame so that said working tool unit has a storage attitude and a working attitude, wherein when said working tool unit is in said storage attitude it extends forwardly of said cab;

said working tool unit comprising:

first boom rockably mounted on said turning frame;

a second boom rockably mounted on said first boom;

an arm rockably mounted on said second boom;

a working tool mounted on said arm;

a first boom cylinder mounted between said turning frame and said second boom to rock said second boom with respect to said turning frame;

a second boom cylinder mounted between said second boom and said first boom to rock said second boom with respect to said first boom;

an arm cylinder mounted between said second boom and said arm to rock said arm with respect to said second boom;

a boom support pin rockably connecting said first boom and said turning frame;

a first pin rockably connecting said first boom and said second boom;

a second pin rockably connecting said second boom and a first end of said first boom cylinder, wherein said second pin is located above a first line between said boom support pin and said first pin while said working tool unit is in said storage attitude;

a third pin rockably connecting a first end of said second boom cylinder to said second boom, wherein said third pin is located so that said second boom cylinder does not traverse said first line while said working tool unit is in said storage attitude;

a fourth pin rockably connecting a second end of said first boom cylinder and said turning frame, and a fifth pin rockably connecting a second end of said second boom cylinder to said first boom;

wherein said second pin also connects a first end of said arm cylinder to said second boom, and wherein a sixth pin connects a second end of said arm cylinder to said arm.

* * * * *